United States Patent [19]

Jackson

[11] Patent Number: 5,044,008

[45] Date of Patent: Aug. 27, 1991

[54] DENTAL FILM CARTRIDGE CUSHION

[76] Inventor: Reginald B. Jackson, 399 Bay View Ter., Costa Mesa, Calif. 92627

[21] Appl. No.: 449,573

[22] Filed: Dec. 12, 1989

[51] Int. Cl.[5] ..... G03C 3/00

[52] U.S. Cl. ..... 378/168; 378/171

[58] Field of Search ..... 206/455; 156/73.1; 378/169, 168, 171

[56] References Cited

U.S. PATENT DOCUMENTS

| | | | |
|---|---|---|---|
| 1,537,925 | 5/1925 | Bolin . | |
| 1,631,492 | 6/1927 | Marler . | |
| 1,631,497 | 6/1927 | Marler | 378/169 |
| 1,994,579 | 3/1935 | Hodgson | 250/34 |
| 2,010,281 | 8/1935 | Van Valkenburg | 250/34 |
| 3,876,072 | 4/1975 | Phillips | 206/455 |
| 3,941,246 | 3/1976 | Duden | 206/455 |
| 4,244,762 | 1/1981 | Holson | 156/73.1 |
| 4,305,988 | 12/1981 | Köcher | 156/73.1 |
| 4,626,216 | 12/1986 | Strong-Grainger | 433/229 |
| 4,805,201 | 2/1989 | Strong-Grainger | 378/169 |

*Primary Examiner*—Edward P. Westin
*Assistant Examiner*—Kim-Kwok Chu
*Attorney, Agent, or Firm*—Stetina and Brunda

[57] ABSTRACT

A cushion for dental film cartridges and a method for forming the same are disclosed. The cushion comprises first and second layers of foam or a like material bonded together about their common periphery and having a central opening passing therethrough. The foam cushion is installed about the periphery of a film cartridge such as those commonly used in dentistry to facilitate x-raying of the teeth. The foam cushion surrounds and covers the typically hard and sharp edges of the film cartridges to prevent discomfort and pain due to abrasion of the gums and soft mouth tissue.

20 Claims, 1 Drawing Sheet

DENTAL FILM CARTRIDGE CUSHION

FIELD OF THE INVENTION

The present invention relates generally to dental film cartridges and more particularly to a cushion for dental film cartridges and a method for forming the same. The cushion comprises first and second layers of foam or a like material bonded together about their common periphery and having a central opening passing therethrough. The foam cushion is installed about the periphery of a film cartridge such as those commonly used in dentistry to facilitate x-raying of the teeth. The foam cushion surrounds and covers the typically hard and sharp edges of the film cartridges to prevent discomfort and pain due to abrasion of the gums and soft mouth tissue.

BACKGROUND OF THE INVENTION

The use of film cartridges in the x-raying of human teeth is well known. Such film cartridges are placed on one side of the teeth to be x-rayed and the teeth are then irradiated by the x-ray machine from the opposite side.

Periapical radiographs provide the dentist with a complete x-ray of a tooth from the crown to the root. Therefore, a film cartridge used in a periapical radiograph must be large enough to cover the entire tooth and must be placed such that the entire tooth is x-rayed. In order to obtain a minimum of distortion in the exposure, a technique known as "paralleling" is used. This technique involves placing the film cartridge in a plane substantially parallel to the long axis of the tooth to be x-rayed. The film cartridge must remain in this plane during the x-raying process to obtain a proper exposure.

Often a bite-wing film cartridge is used wherein a tab folds out in a substantially perpendicular direction from the film cartridge. The tab is bitten down upon by the patient in order to hold the film cartridge in place during the x-ray process and thus insure a proper exposure. Bite-wing x-rays are typically used for detecting interproximal cavities. Bite-wing x-rays do not require exposure of the root tips as with periapical exposures.

The requirements for size and precise placement of the film cartridge cause significant problems for the patient. It is difficult to place the film cartridge in an optimal position and to maintain that position. The edges of the film cartridge commonly abrade the gums and soft tissues of the mouth, causing significant discomfort and occasionally even intense pain. This problem is particularly significant with children due to their lower tolerance of pain. Children are more likely to change the position of the film cartridge within their mouth to alleviate discomfort. This action causes deterioration in the quality of the exposure. Often the patient is required to cooperate in maintaining the placement of the film cartridge by biting firmly on the bite-wing tab. It can be extremely difficult to obtain this cooperation when such an optimal placement of the film cartridge results in severe discomfort to the patient.

There are two types of film cartridges in common use. The first type utilizes a stiff paperboard covering. The edges of the paperboard covering are hard and can cause considerable pain when abrading the gum and soft tissues of the mouth. The second type of film cartridge has a plastic covering which is heat sealed about its perimeter. The plastic cartridge has a thinner and more flexible edge. However, the edge of the plastic cartridge is somewhat sharper than that of the paper cartridge.

The plastic cartridge, therefore, also causes considerable pain and discomfort when used.

Cushions for radiographic dental film are disclosed in prior art U.S. Pat. No. 1,994,579, issued to Hodgson, U.S. Pat. No. 1,537,925, issued to Bolin. U.S. Pat. No. 1,631,497, issued to Marler, and U.S. Pat. Nos. 4,626,216 and 4,805,201, both issued to Strong-Grainger. The Hodgson patent discloses a dental film cartridge that has an absorbent pad structure attached to one surface of the film cartridge. The absorbent pad structure extends across the surface of the dental film cartridge, thus completely covering one side of the cartridge. While the Hodgson dental film cartridge does alleviate the problem of discomfort, it does so by increasing the bulk of the film cartridge. It not only significantly increases the cost of the film cartridge, but also makes it considerably more difficult to obtain properly exposed radiographs.

It should be noted that the "bisecting" method of obtaining radiographs was popular at the time the Hodgson device was invented. The "bisecting" technique permitted the placement of the film cartridge at a more comfortable angular orientation within the patient's mouth. The presently used "paralleling" technique requires much more precise positioning of the film cartridge.

The absorbent pad of the Hodgson device increases the thickness of the film cartridge considerably. It also increases the overall cartridge dimensions by a considerable amount, thereby making the film cartridge significantly taller and wider. Such increased size renders the Hodgson device more difficult to position properly, and therefore undesirable for use in the "paralleling" technique. The pad of the Hodgson device is constructed of pressed absorbent cotton. While this generally increase comfort to the patient, it will not compress significantly when pressed against the soft tissues of the sublingual mucosa below the patient's tongue or the hard or soft pallet above the tongue.

The Bolin patent discloses a dental film cartridge having a thick bead about the perimeter. The bead is intended to decrease the amount of discomfort experienced by the patient. The bead is formed of an elastomer which extends about the periphery of the film cartridge. This device, like the Hodgson device, increases the overall length and width substantially, thereby making placement in the "paralleling" method significantly more difficult.

The Marler patent discloses a dental x-ray film cartridge having a thin flexible bead about its periphery which alleviates to some extent the positioning problems caused by the increase in cartridge size associated with the Hodgson and Bolin devices. The Marler device utilizes a peripheral bead similar in structure to a rubber band and does not significantly increase the length, width or thickness of the film cartridge. The Marler device does not cover one entire surface of the cartridge as do both the Hodgson and Bolin devices. The primary problems associated with the Marler device are a comparatively high cost of manufacture and difficulty of use.

The Marler device is formed by the injection molding process. It thus requires comparatively expensive tooling and has a comparatively high per unit manufacturing cost. Installation of the Marler device upon a film cartridge is relatively difficult since the Marler device necessarily has a smaller inside perimeter than the perimeter of the film cartridge. This is required since the Marler device relies upon the elastic characteristic of the rubber material from which it is constructed to secure it about the periphery of the film cartridge. Thus, the user is required to stretch the Marler device sufficiently that the film cartridge can be inserted therein and to manually insert the film cartridge into the stretched device while the device is under tension. A portion of the film cartridge is typically inserted into the Marler device and then the Marler device is stretched to encompass the remainder of the film cartridge. This is a necessarily difficult task requiring a significant amount of manual dexterity and skill to accomplish.

The Strong-Grainger patents disclose a foam padding for a dental film cartridge. The padding of the Strong-Grainger device does not extend about the full perimeter of the film cartridge. Instead, it extends about approximately one-half the perimeter and thus does not provide complete protection. The padding of the Strong-Grainger device is more susceptible to loosening than the other prior art devices since it does not extend about the full perimeter of the film cartridge.

As such, although the prior art has recognized to a limited extent the problem of minimizing patient discomfort while obtaining the best quality dental radiographs, the proposed solutions have to date been ineffective in providing a satisfactory remedy.

SUMMARY OF THE INVENTION

The present invention specifically addresses and alleviates the above-mentioned deficiencies associated in the prior art. More particularly, the present invention comprises a cushion for dental film cartridges and a method for forming the same. The cushion comprises first and second layers of foam or a like material bonded together about their common periphery and having a central opening passing therethrough. The foam cushion is installed about the periphery of a film cartridge such as those commonly used in dentistry to facilitate x-raying of the teeth. The foam cushion surrounds and covers the typically hard and sharp edges of the film cartridges to prevent discomfort and pain due to abrasion of the gums and soft mouth tissue.

The dental film cartridge cushion of the present invention is manufactured by applying two layers of a resilient foam material to a paper substrate having an adhesive layer upon one surface. The foam is applied to the paper such that the lower most layer of foam adheres to the adhesive of the paper substrate. Rolls of foam and paper are preferably utilized to provide for a continuous manufacturing process. A seam is formed by ultrasonically welding the two layers of foam material together to define the shape of the dental cartridge cushion. The cushions are die-cut from the roll stock and remain adhered to the paper substrate. The dental cartridge cushions thus formed may be rolled and packaged to be dispensed in a manner similar to the dispensing of adhesive tape. A desired quantity of dental cartridge cushions is pulled from a slot in the cartridge and separated from the package by tearing the paper substrate. The dental cartridge cushions are then peeled from the paper substrate and installed over dental film cartridges.

These as well as other future advantages will be more apparent from the following description and drawings. It is understood the changes in the specific structure shown and described may be made within the scope of the claims without departing from the spirit of the invention.

DETAILED DESCRIPTION OF THE PREFERRED EMBODIMENT

The dental cartridge cushion of the present invention is illustrated in FIGS. 1 through 6 which depict a presently preferred embodiment of the invention.

Figure 1:
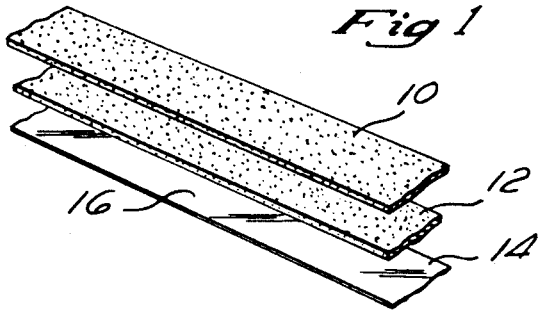
FIG. 1 is a perspective view of the two layers of foam material and the single layer of paper showing the relative positions of each material.

Referring now to FIG. 1, first 10 and second 12 layers of a resilient material such as a plastic foam are laminarly applied to a non-resilient substrate 14 such as paper. Those skilled in the art will recognize that various plastic foams, such as polyester and polyether polyurethane, chemically crosslinked polyethylene, or extruded non-crosslinked polyethylene are suitable for use as the resilient foam material 12 and 14. Those skilled in the art will also recognize that various types of paper possess sufficient strength to be suitable for use as the substrate. The substrate has an adhesive coating upon its upper surface 16. In the preferred embodiment rolls of plastic foam material 10 and 12 and paper 14 are utilized for ease of manufacturing, although those skilled in the art will recognize that other types of material stock can be used.

The paper substrate 14 aids in the manufacturing and handling processes. The paper substrate 14 provides a durable non-stretching base suitable for use with automated materials handling apparatus such as pinch rollers which may be used to feed the material from one step in the manufacturing process to another. Without the paper substrate 14 the resilient foam material layers 10 and 12 may tend to stretch and deform. The use of a non-resilient paper substrate therefore simplifies the manufacturing process. Those skilled in the art will recognize that manufacturing and handling techniques may be utilized which do not require the use of such a non-resilient substrate.

Figure 2:
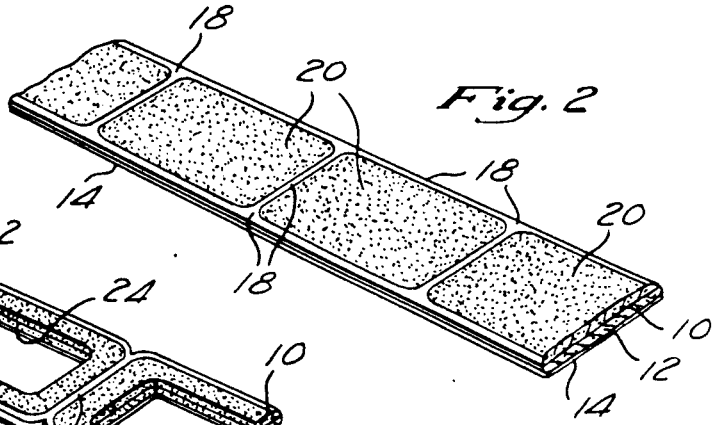
FIG. 2 is a perspective view of the two layers of foam material after the lower layer of foam material has been bonded to the paper and the two layers of foam have been ultrasonically welded about a common periphery defining the shape of the dental cartridge cushions.

Referring now to FIG. 2, the upper 10 and lower 12 layers of foam material are bonded together by a process such as ultrasonic welding to form a seam 18 such that the periphery of the individual dental cartridge cushions is defined. The centrally located foam material 20 is not ultrasonically welded together and therefore remains as two distinct layers. The first 10 and second 12 layers of resilient material can be bonded together prior to their application to the non-resilient paper substrate 14.

Figure 3:
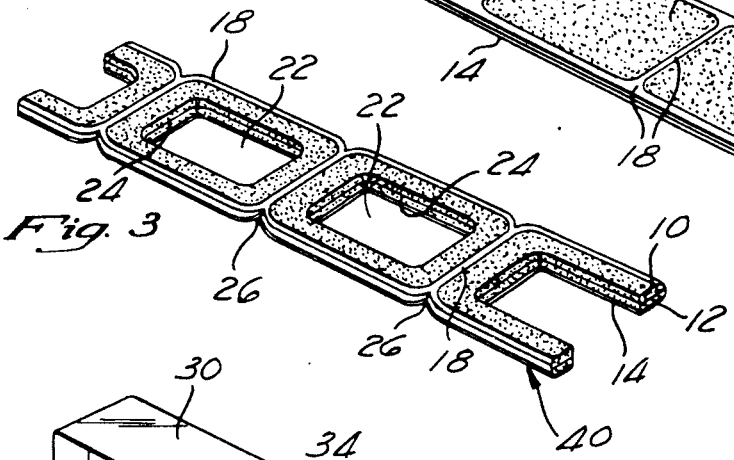
FIG. 3 is a perspective view of the dental cartridge cushions after they have been die-cut.

Referring now to FIG. 3, the dental film cartridge cushions are shown after cutting. Die-cutting or a similar process is used to remove excess foam and paper from the corner areas 26 where adjacent cushions meet and to punch out the center openings 22 of the cushions. Die-cutting also separates each dental cartridge cushion from adjacent dental cartridge cushions by forming a cut 44, best seen in FIG. 4, through both layers of foam 10 and 12 where adjacent dental cartridge cushions touch. Cut 44 does not extend through the paper layer 14. The paper layer 14 may be perforated along the line formed by out 44 to aid in the dispensing of the dental cartridge cushions.

Figure 4:
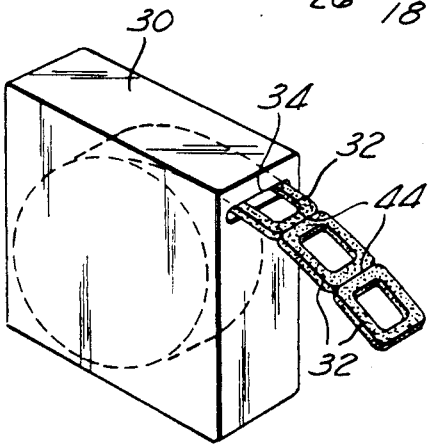
FIG. 4 is a perspective view of a dispenser showing several dental cartridge cushions extending from a slot ready to be dispensed.

Referring now to FIG. 4, the dental film cartridge cushions of the present invention can be formed into a roll and inserted into a box 30 for convenient dispensing. One or more of the dental cartridge cushions 32 can extend from a slot 34. The dental film cartridge cushions 32 may be dispensed by withdrawing the desired number of dental cartridge cushions 32 from the box 30 and then tearing the paper substrate 14 to detach the desired number of dental cartridge cushions 32 from the remainder. The paper substrate 14 is peeled off of each dental cartridge cushion 40 prior to use.

Figure 5:
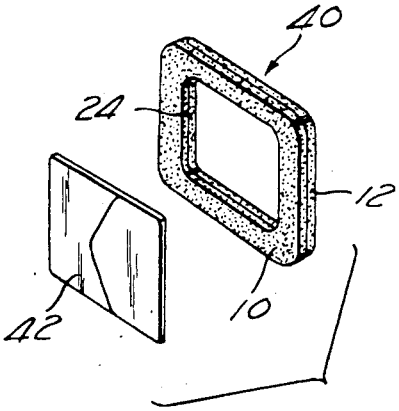
FIG. 5 is a perspective view of a dental cartridge cushion and a bite-wing film cartridge showing their respective orientations immediately prior to application of the dental cartridge cushion to the bite-wing film cartridge.
Figure 6:
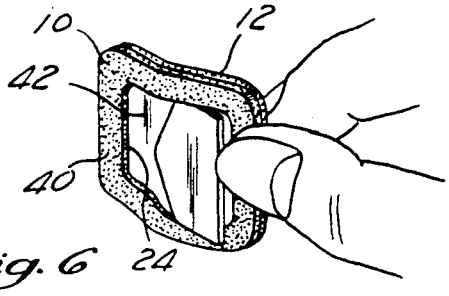
FIG. 6 is a perspective view of the dental cartridge cushion as it is being installed upon the bite-wing film cartridge of FIG. 5.

Referring now to FIG. 5, the dental cartridge cushion 40 is installed about the periphery of a dental film cartridge 42 by inserting the dental film cartridge 42 between the first 10 and second 12 layers of foam material. The dental film cartridge 42 is forced into the slot 24 formed at the interface of the two foam layers 10 and 12. As shown in FIG. 6, one end of the dental film cartridge 42 may be inserted into the dental cartridge cushion 40 and then the dental cartridge cushion 40 can be stretched slightly to install it over the remaining end of the dental film cartridge 42. Very little tension is required to stretch the dental cartridge cushion 40, making it very easy to install. The dental film cartridge cushion 40 thus forms a soft resilient covering over the sharp hard edges of the dental film cartridge 42 to reduce discomfort during the dental x-raying process.

It is understood that the exemplary dental film cartridge cushion described herein and shown in the drawings represents only a presently preferred embodiment of the invention. Indeed, various modifications and additions may be made to such embodiment without departing from the spirit and scope of the invention. For example, the size and location of the central opening can be varied significantly while still functioning to receive a dental film cartridge. Also, various means of bonding the two layers of resilient material together are possible. Thus, these and other modifications and additions may be obvious to those skilled in the art and may be implemented to adapt the present invention for use in a variety of different applications.

What is claimed is:

1. A dental film cartridge cushion for reducing discomfort during dental x-rays, the cushion comprising:

a. A first layer of resilient material formed generally in the shape of a dental film cartridge;

b. A second layer of resilient material likewise formed generally in the shape of a dental film cartridge laminarly disposed along one surface of said first layer of resilient material;

c. A central aperture forming a common opening through both said first and second layers of resilient material, said central aperture being formed generally in the shape of a dental film cartridge; and d. Wherein said first layer of resilient material and said second layer of resilient material are bonded together about their common periphery such that a groove is formed within the central aperture between said first and second layers of resilient material such that a dental film cartridge is disposable within said groove.

2. The dental film cartridge cushion as recited in claim 1 wherein the first and second layers of resilient material are bonded together by ultrasonic welding.

3. The dental film cartridge cushion as recited in claim 2 wherein the groove formed between said first and second layers of resilient material is specifically sized to receive a dental film cartridge.

4. The dental film cartridge cushion as recited in claim 3 further comprising a non-resilient substrate upon which said first and second layers of resilient material are laminarly disposed.

5. The dental film cartridge cushion as recited in claim 4 wherein said non-resilient substrate is comprised of paper.

6. The dental film cartridge cushion as recited in claim 5 wherein said first and second layers of resilient material are comprised of a plastic foam.

7. A roll of dental film cartridge cushions comprising:

a. A first layer of resilient foam material;

b. A second layer of resilient foam material laminarly disposed along one surface of said first layer of resilient foam material;

c. A central aperture forming a common opening through both said first and second layers of resilient foam material;

d. A paper substrate upon which said first and second layers of resilient foam material are laminarly disposed;

e. Wherein said first layer of resilient foam material and said second layer of resilient foam material are ultrasonically bonded together about their periphery such that a groove is formed within the central aperture between said first and second layers of resilient foam material, the groove being specifically sized to receive a dental film cartridge; and f. Wherein said first and second layers of resilient foam material and said paper substrate are elongate planar layers sufficiently flexible to be formed into a roll.

8. The dental film cartridge cushions as recited in claim 7 further comprising a container within which the dental film cartridge cushions may be disposed, said container having an aperture through which said dental film cartridge cushions may pass to facilitate dispensing.

9. A method for manufacturing dental film cartridge cushions comprising the steps of:

a. Bonding together two layers of a resilient material such that a seam is formed, the seam being substantially of the size and shape of the periphery of a dental film cartridge;

b. Cutting a common central opening through the two layers of resilient material, the central opening being large enough to receive a dental film cartridge when stretched.

c. Cutting adjacent dental film cartridge cushions apart by cutting the two layers of resilient material along a line defining their common interface.

10. The method as recited in claim 9 wherein the step of bonding together two layers of resilient material comprises ultrasonically welding the two pieces of resilient material together.

11. The method as recited in claim 10 further comprising the step of bonding the two layers of resilient material to a non-resilient substrate.

12. The method as recited in claim 11 wherein the step of bonding the two layers of resilient material to a non-resilient substrate comprises bonding the two layers of resilient material to paper.

13. The method as recited in claim 12 further comprising the step of cutting resilient material away from the dental film cushions in the area of the dental film cushion corners, to form rounded corners.

14. The method as recited in claim 13 wherein the step of bonding together two layers of a resilient material comprises bonding together two layers of a resilient elongate planar material.

15. The method as recited in claim 14 further comprising the step of forming the two layers of elongate planar material into a roll.

16. The method as recited in claim 15 further comprising the step of disposing the two layers of elongate planar material formed into a roll within a container, the container suitable for dispensing a desired quantity of dental cartridge cushions.

17. A method for manufacturing dental film cartridge cushions comprising the steps of:

(a) forming a first layer of resilient material in the shape of a dental film cartridge, said first layer being formed to have a central opening therethrough, said opening being formed generally in the shape of a dental film cartridge;

(b) forming a second layer of resilient material in the shape of a dental film cartridge, said second layer being formed to have a central opening therethrough, said opening being formed generally in the shape of a dental film cartridge, said second layer being formed in laminar juxtaposition to said first layer;

(c) wherein a groove is formed intermediate said first and second layers such that a dental film cartridge may be disposed therein.

18. The method as recited in claim 17 further comprising the step of bonding said first and second layers of resilient material to a non-resilient substrate.

19. The method as recited in claim 18 wherein:

(a) the steps of forming said first and second layers of resilient material comprise forming first and second layers of a plastic foam; and (b) the step of bonding said first and second layers of resilient material to a non-resilient substrate comprises bonding said first and second layers of resilient material to a paper substrate.

20. The method as recited in claim 19 wherein the steps of forming said first and second layers of resilient material comprise injection molding.

* * * * *